US005938846A

United States Patent [19]

Swan

[11] Patent Number: 5,938,846

[45] Date of Patent: Aug. 17, 1999

[54] BASEBOARD PROTECTOR FOR FLOOR WAXING

[76] Inventor: Marilyn D. Swan, Box 65 Lake Isle, Alberta, Canada, T0E 1HO

[21] Appl. No.: 08/968,821

[22] Filed: Nov. 6, 1997

[51] Int. Cl.[6] ..... B05C 11/11

[52] U.S. Cl. ..... 118/504; 15/257.01

[58] Field of Search ..... 15/257.01, 248.1; 118/504, 505, 301, 213, 406

[56] References Cited

U.S. PATENT DOCUMENTS

| | | | |
|---|---|---|---|
| 3,241,519 | 3/1966 | Lloyd | 118/504 |
| 3,678,887 | 7/1972 | Smith | 118/504 |
| 5,196,065 | 3/1993 | Jozwiak | 118/504 |
| 5,224,418 | 7/1993 | Simmons | 118/504 |
| 5,230,738 | 7/1993 | Wheeler | 118/504 |
| 5,342,447 | 8/1994 | Nudo et al. | 118/504 |

*Primary Examiner*—Brenda A. Lamb

[57] ABSTRACT

A baseboard protector is provided including a frame having a pair of long members and a pair of short members. The short members are coupled between the long members such that the short members reside in perpendicular relationship with the long planar members. By this structure, a mop may be situated within the frame such that one of the long members is in sliding abutment with a baseboard, thereby preventing the baseboard from becoming wet when the mop is reciprocated along a wall for waxing a floor adjacent thereto.

2 Claims, 2 Drawing Sheets

BASEBOARD PROTECTOR FOR FLOOR WAXING

BACKGROUND OF THE INVENTION

1. Field of the Invention

The present invention relates to a baseboard protector and more particularly pertains to preventing contact between a mop and a baseboard while waxing a floor.

2. Description of the Prior Art

The use of mops is known in the prior art. More specifically, mops heretofore devised and utilized for the purpose of cleaning floors are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,280,444; U.S. Pat. No. 4,258,654; U.S. Pat. No. 5,103,762; and U.S. Pat. No. 4,811,446; and U.S. Pat. No. 5,165,136.

In this respect, the baseboard protector according to the present invention substantially departs from the conventional concepts and designs of the prior art, and in so doing provides an apparatus primarily developed for the purpose of preventing contact between a mop and a baseboard while waxing a floor.

Therefore, it can be appreciated that there exists a continuing need for a new and improved baseboard protector which can be used for preventing contact between a mop and a baseboard while waxing a floor. In this regard, the present invention substantially fulfills this need.

SUMMARY OF THE INVENTION

In view of the foregoing disadvantages inherent in the known types of mops now present in the prior art, the present invention provides an improved baseboard protector. As such, the general purpose of the present invention, which will be described subsequently in greater detail, is to provide a new and improved baseboard protector which has all the advantages of the prior art and none of the disadvantages.

To attain this, the present invention essentially comprises a base board situated along a lower edge of a wall next to an adjacent floor. Further provided is a mop having an elongated handle portion. A bottom portion of the mop includes a plurality of mop strings coupled to a lower end of the handle portion. Such strips are adapted to lay down wax on a floor. The present invention includes a frame with a pair of long planar rectangular members. Each long planar rectangular member has a periphery defined by horizontally oriented parallel top and bottom long edges and a pair of vertical side short edges formed therebetween. The frame further includes a pair of short planar rectangular members each having a periphery defined by horizontally oriented parallel top and bottom long edges and a pair of vertical side short edges formed therebetween. As shown in FIGS. 2 & 3, the short edges of the short planar rectangular members are coupled between the short edges of the long planar rectangular members. The short planar rectangular members reside in parallel vertical planes and the long planar rectangular members reside in parallel vertical planes which are maintained in perpendicular relationship with those of the short planar rectangular members. For reasons that will become apparent hereinafter, the bottom long edge of each of the short planar rectangular members has a rectangular cutout formed therein. The cutout defines a slot when the bottom long edges of the members are resting on the floor. Also included is a pair of upper supports each having a planar rectangular configuration. Preferably, the upper supports are equipped with a size and shape similar to that of the short planar rectangular members of the frame. The upper supports are each coupled along both the top long edge of the corresponding short planar rectangular member and to end portions of the top long edges of the long planar rectangular members. When mounted on the frame, the upper supports reside in a common horizontally oriented plane thereby forming a pair of compartments at each end of the frame.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baseboard protector which has all the advantages of the prior art mops and none of the disadvantages.

It is another object of the present invention to provide a new and improved baseboard protector which may be easily and efficiently manufactured and marketed.

It is a further object of the present invention to provide a new and improved baseboard protector which is of a durable and reliable construction.

An even further object of the present invention is to provide a new and improved baseboard protector which is susceptible of a low cost of manufacture with regard to both materials and labor, and which accordingly is then susceptible of low prices of sale to the consuming public, thereby making such baseboard protector economically available to the buying public.

Still yet another object of the present invention is to provide a new and improved baseboard protector which provides in the apparatuses and methods of the prior art some of the advantages thereof, while simultaneously overcoming some of the disadvantages normally associated therewith.

Still another object of the present invention is to prevent contact between a mop and a baseboard while waxing a floor.

Lastly, it is an object of the present invention to provide a new and improved baseboard protector including a frame having a pair of long members and a pair of short members. The short members are coupled between the long members such that the short members reside in perpendicular relationship with the long planar members. By this structure, a mop may be situated within the frame such that one of the long members is in sliding abutment with a baseboard, thereby preventing the baseboard from becoming waxed when the mop is reciprocated along a wall for waxing a floor adjacent thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
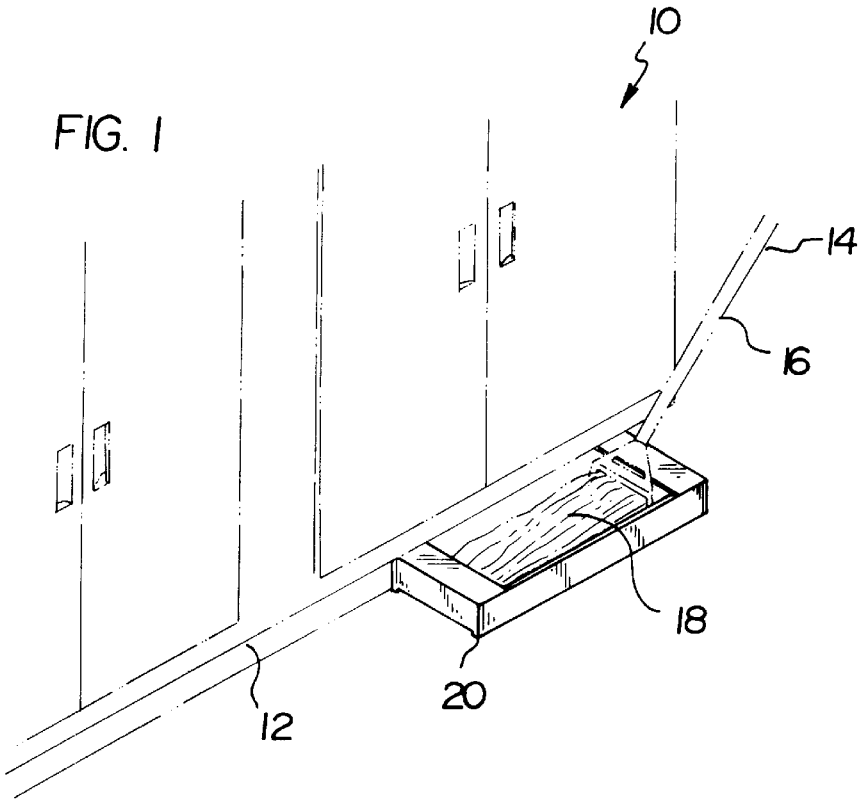
FIG. 1 is a perspective illustration of the preferred embodiment of the baseboard protector constructed in accordance with the principles of the present invention.

With reference now to the drawings, and in particular to FIG. 1 thereof, a new and improved baseboard protector embodying the principles and concepts of the present invention and generally designated by the reference numeral 10 will be described.

The present invention, the new and improved baseboard protector, is comprised of a plurality of components. Such components in their broadest context include a frame and a pair of upper supports. Such components are individually configured and correlated with respect to each other so as to attain the desired objective.

More specifically, it will be noted that the system 10 of the present invention is adapted for use with a base board 12 situated along a lower edge of a wall next to a floor. Further provided is a mop 14 having an elongated handle portion 16. A bottom portion of the mop includes a plurality of waxing strings 18 coupled to a lower end of the handle portion. Such strings are adapted to lay down wax on a floor.

The present invention includes a rigid plastic frame 20 with a pair of long planar rectangular members 22. Each long planar rectangular member has a periphery defined by horizontally oriented parallel top and bottom long edges and a pair of vertical side short edges formed therebetween. The frame further includes a pair of short planar rectangular members 24 each having a periphery defined by horizontally oriented parallel top and bottom long edges and a pair of vertical side short edges formed therebetween. In the preferred embodiment, the short planar rectangular members each have a length that is less than ⅓ that of the long planar rectangular members. Further, all of the planar rectangular members have a common height.

Figure 2:
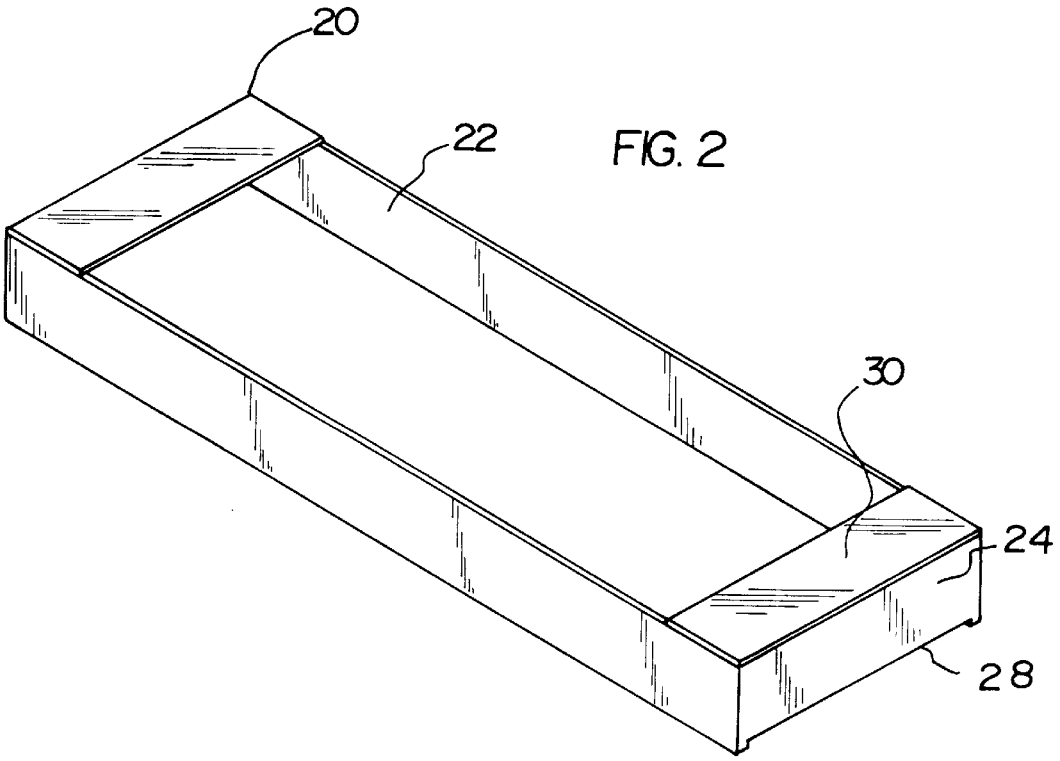
FIG. 2 is a top perspective view of the present invention.
Figure 3:
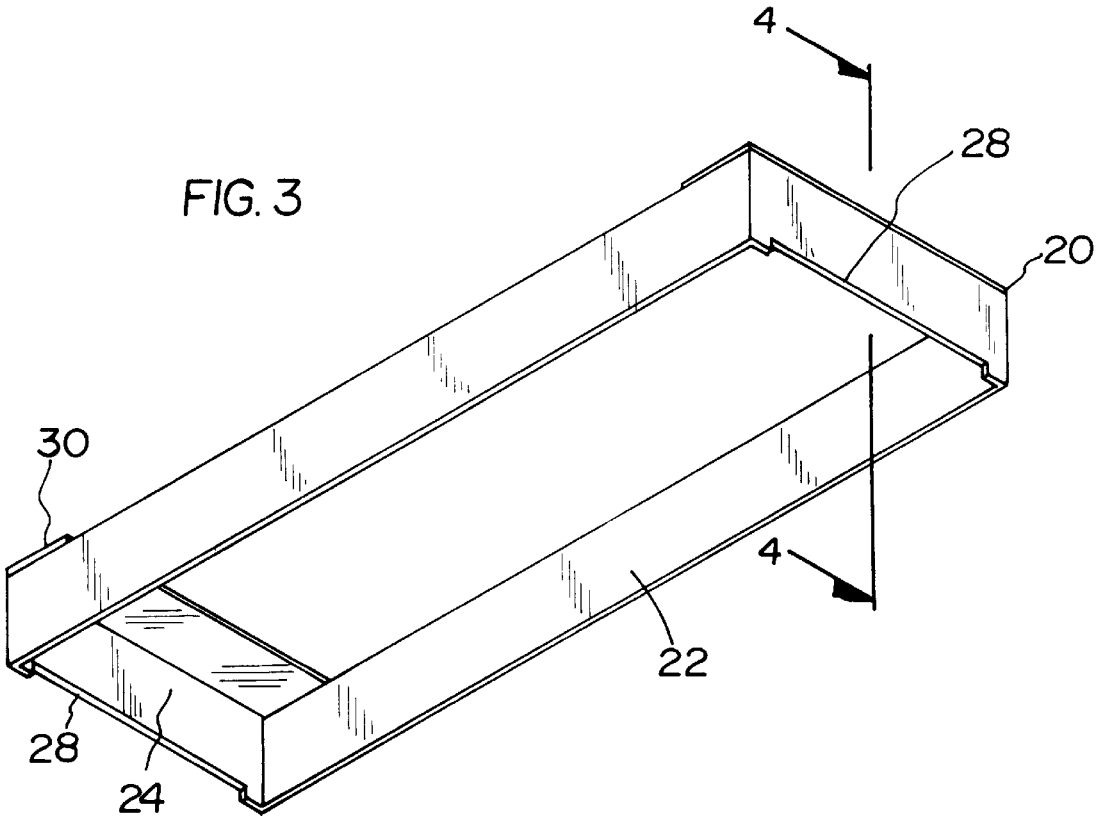
FIG. 3 is a bottom perspective view of the present invention.
Figure 4:
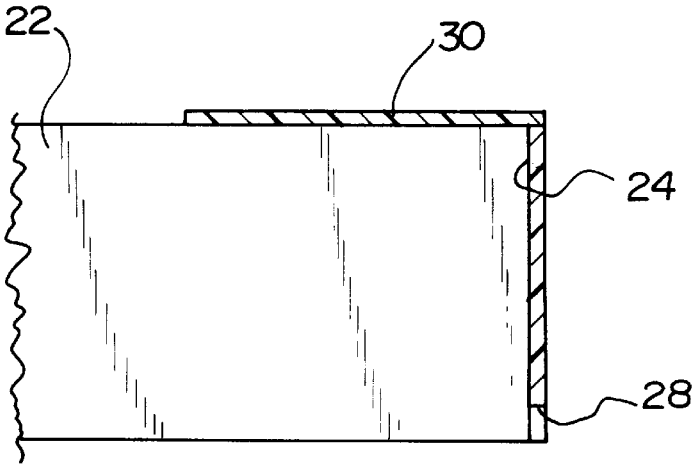
FIG. 4 is a cross-sectional view of the present invention taken along line 4—4 shown in FIG. 3.

As shown in FIGS. 2 & 3, the short edges of the short planar rectangular members are coupled between the short edges of the long planar rectangular members. The short planar rectangular members reside in parallel vertical planes and the long planar rectangular members reside in parallel vertical planes which are maintained in perpendicular relationship with those of the short planar rectangular members. The planar rectangular member together define a length of 23 inches and a width of about 9 inches.

For reasons that will become apparent hereinafter, the bottom long edge of each of the short planar rectangular members has a rectangular cutout 28 formed therein. The cutout defines a slot when the bottom long edges of the members are resting on the floor.

Also included is a pair of upper supports 30 each having a planar rectangular configuration. Preferably, the upper supports are equipped with a size and shape similar to that of the short planar rectangular members of the frame. The upper supports are each coupled along both the top long edge of the corresponding short planar rectangular member and to end portions of the top long edges of the long planar rectangular members. When mounted on the frame, the upper supports reside in a common horizontally oriented plane thereby forming a pair of compartments at each end of the frame. One function of the upper supports is to strengthen the coupling between the planar rectangular members. For reasons that will become apparent hereinafter, one of the upper supports, designated as the front upper support, has a width twice that of the remaining upper support thus defining an enlarged compartment.

During use, the bottom portion of the mop may be situated within the frame such that one of the long planar rectangular members is in sliding abutment with the baseboard. As such, the baseboard is prevented from becoming wet when the mop is reciprocated along the wall for waxing the floor adjacent thereto. It should be noted that the compartments are adapted to contain the bottom portion of the mop when the mop strings are gathered as a result of the reciprocating motion. Further, the slot defining cut outs allow fluid to exit and enter the frame during use and also reduce the contact surface between the frame and the floor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved baseboard protector comprising, in combination:

a base board situated along a lower edge of a wall next to an adjacent floor;

a mop having an elongated handle portion and a bottom portion including a plurality of waxing strings coupled to a lower end of the handle portion to lay down wax on a floor;

a frame including a pair of long planar rectangular members each having a periphery defined by horizontally oriented parallel top and bottom long edges and a pair of vertical side short edges formed therebetween, the frame further including a pair of short planar rectangular members each having a periphery defined by horizontally oriented parallel top and bottom long edges and a pair of vertical side short edges formed therebetween, the short edges of the short planar rectangular members coupled between the short edges of the long planar rectangular members such that the short planar rectangular members reside in parallel vertical planes and the long planar rectangular members reside in parallel vertical planes which are maintained in perpendicular relationship with those of the short planar rectangular members, the bottom long edge of each of the short planar rectangular members having a rectangular cutout formed therein defining a slot when the bottom long ledges of the members are resting on the floor; and a pair of upper supports each having a planar rectangular configuration with a size and shape similar to that of the short planar rectangular members of the frame, the upper supports each coupled along the top long edge of the corresponding short planar rectangular member and further coupled to end portions of the top long edges of the long planar rectangular members, wherein the upper supports reside in a common horizontally oriented plane;

whereby the bottom portion of the mop may be situated within the frame such that one of the long planar rectangular members is in sliding abutment with the baseboard, thereby preventing the baseboard from becoming wet when the mop is reciprocated along the wall for waxing the floor.

2. A baseboard protector system for use with a baseboard situated along a lower edge of a wall next to a floor comprising:

a mop having an elongated handle portion and a bottom portion including a plurality of cleaning strips coupled to a lower end of the handle portion to absorb water for cleaning purposes; and a frame including a pair of long members and a pair of short members, the long members having lower edges in a first lower plane in contact with the floor, the short members coupled between the long members such that the short members reside in perpendicular relationship with the long members;

whereby the bottom portion of the mop may be situated within the frame such that one of the long members is in sliding abutment with the baseboard, thereby preventing the baseboard from becoming wet when the mop is reciprocated along the wall for cleaning the floor;

wherein a bottom edge of at least one of the members has a cutout formed therein thus defining a slot with an upper edge in a second plane above the first plane when the bottom edges of the members are resting on the floor.

* * * * *